US005410819A

United States Patent [19]

Joiner

[11] Patent Number: 5,410,819

[45] Date of Patent: May 2, 1995

[54] MOUNTING SYSTEM FOR PAPER DRYER NOZZLE BOX

[75] Inventor: John R. Joiner, Vancouver, Wash.

[73] Assignee: James River Paper Company, Inc., Richmond, Va.

[21] Appl. No.: 214,450

[22] Filed: Mar. 18, 1994

[51] Int. Cl.[6] ..... F26B 11/02

[52] U.S. Cl. ..... 34/122; 34/111; 34/114

[58] Field of Search ..... 34/108, 110, 111, 113-116, 34/121-123

[56] References Cited

U.S. PATENT DOCUMENTS

| | | | |
|---|---|---|---|
| 3,183,607 | 5/1965 | Beachler | 34/122 |
| 3,541,697 | 11/1970 | Villalobos | 34/122 |
| 3,855,713 | 12/1974 | Portouw | 34/122 |
| 4,168,580 | 9/1979 | Weinmann | 34/122 |

*Primary Examiner*—Denise L. Gromada
*Attorney, Agent, or Firm*—Thomas R. Lampe

[57] ABSTRACT

One or more nozzle boxes are supported by support walls of a yankee dryer hood. The mounting arrangement serves to maintain the nozzle boxes concentric to the yankee, reduce thermal stresses, and alleviate edge misalignment problems between the nozzle boxes and web cages caused by thermal expansion.

10 Claims, 4 Drawing Sheets

MOUNTING SYSTEM FOR PAPER DRYER NOZZLE BOX

TECHNICAL FIELD

This invention relates to the drying of paper webs. More particularly, the invention is concerned with apparatus for mounting a nozzle box in a yankee dryer hood.

BACKGROUND ART

Yankee dryers have been used for many years to dry wet paper webs during the paper-making process. Typically, the wet paper web is delivered to and pressed into engagement with the rotating dryer drum with the outer cylindrical surface of the dryer drum delivering the wet paper web to a dryer hood associated with the dryer drum. The dryer drum is heated internally by steam or the like so that the outer surface thereof is maintained at a high temperature. After entering the dryer hood the wet paper web is also subjected to heat on the outer surface (air side) thereof.

It is conventional practice to employ a plurality of nozzle boxes in yankee dryers, the nozzle boxes normally being arrayed in a cross-machine direction to direct heated air against the top surface of the web being dried along the width thereof. Typically, the nozzle boxes are supported by crescent headers arrayed in the machine direction as well as by curved support side plates at the sides of the hood.

Conventional hoods are constructed in such a way that the entire internal structure grows with temperature. In conventional arrangements, the support side plates are directly exposed to the very hot temperatures within the hood compartments. Heating of the support side plates will cause them to deform and tend toward straightening of the plates. The crescent headers are subject to the same action. This deformation results in a lack of concentricity, moving at least some of the nozzle boxes (particularly the end-most boxes) away from the dryer drum and causes operating inefficiencies. Convection heat transfer drops off dramatically as the nozzle boxes move away from the sheet.

It will also be appreciated that extremely high temperatures and variations in temperature can cause potentially harmful stresses to build up in the nozzle boxes and related components, resulting in both structural and performance degradation unless the problem of expansion and contraction due to high temperatures and temperature changes is addressed and corrected.

Another difficulty arising in prior art hood constructions is the expansion of the nozzle boxes which results in significant movement at one end thereof, the other nozzle box end being fixed in position on a structural side plate. This causes misalignment between the nozzle box and a sheet edge.

DISCLOSURE OF INVENTION

The present invention addresses and solves the problems and difficulties associated with nozzle boxes disposed within a yankee dryer hood. More particularly, the present invention employs a combination of structural elements which cooperate in a unique manner to compensate for expansion and contraction of a nozzle box as well as hood side wall structure so that harmful stresses are not generated in the system structural components and the cooperative relationship therebetween is not adversely affected by temperature changes. In addition, structure is provided to compensate for crescent header heating so that change in the shape of crescent headers will not adversely affect nozzle box placement.

The apparatus of the present invention is employed in association with a yankee dryer including a rotatable dryer drum having a paper web support surface for transporting a paper web in the machine direction upon rotation of the dryer drum and a hood having a hood interior at least partially encompassing the dryer drum.

The apparatus includes a nozzle box including nozzle box side walls and nozzle box end walls defining a nozzle box interior. The nozzle box defines at least one exit opening between the nozzle box end walls for directing heated air from the nozzle box interior toward the dryer web paper support surface.

Support walls are provided for supporting the nozzle box at a location adjacent to the dryer drum with the nozzle box extending in the cross-machine direction. The support walls comprise two opposed support walls adjacent to and spaced from the nozzle box end walls.

Interconnection means interconnects the support walls and respective nozzle box end walls to maintain the nozzle box at said location.

The interconnection means comprises projections having distal ends extending between the support walls and the nozzle box end walls and a receptacle for receiving each projection distal end and allowing end-wise movement of the nozzle box end walls relative to the support walls responsive to expansion and contraction of the nozzle box due to changes in temperature of the nozzle box.

Nozzle box engaging means is provided for engaging the nozzle box at a nozzle box location generally mid-length of the nozzle box and preventing substantial end-wise movement of the engaged nozzle box at the nozzle box location.

The projections extend only part way into the interiors of rigid support members located at the support walls and are slidable relative thereto to allow slidable movement between the projections and the rigid support members responsive to expansion or contraction of the nozzle box.

Other features, advantages, and objects of the present invention will become apparent with reference to the following description and accompanying drawings.

BEST MODE FOR CARRYING OUT THE INVENTION

Figure 1:
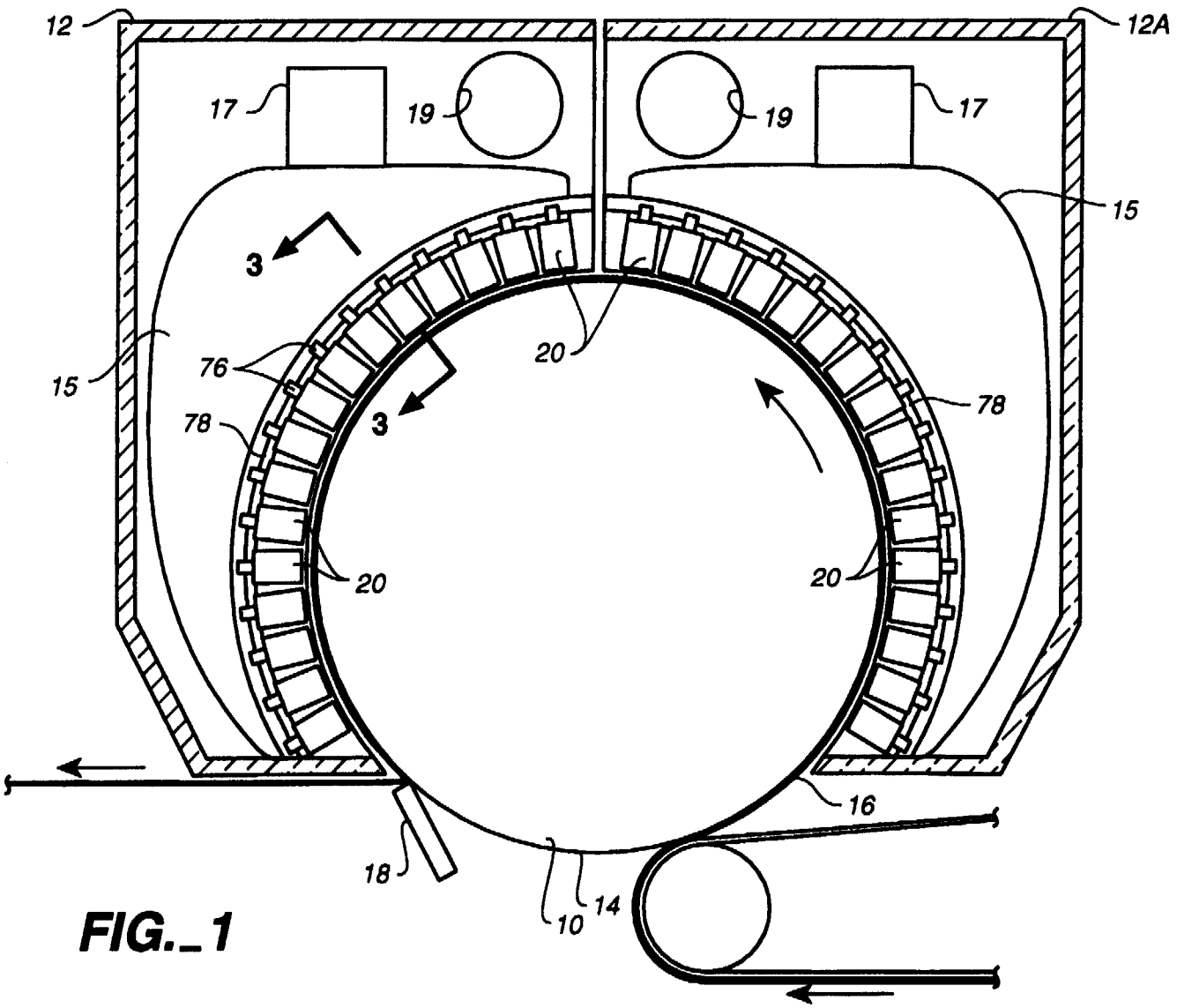
FIG. 1 is a schematic view illustrating a yankee dryer having a plurality of nozzle boxes arrayed about the periphery of the dryer drum and within the interior of a yankee dryer hood.

Referring now to the drawings, a yankee dryer is illustrated, the yankee dryer including a rotatable dryer drum 10 and a hood having hood sections 12 and 12A partially encompassing the dryer drum. As is conventional, the dryer drum has an outer paper web support surface 14 for supporting and transporting a wet paper web 16 through the hood to dry the paper web. A creping blade 18 is utilized to crepe and remove the web from the dryer drum surface in the manner conventional with regard to tissue machines.

As is conventional, crescent headers 15 are deployed in each hood compartment, it being understood that a plurality of crescent headers are in each compartment spaced from one another in the cross-machine direction, each crescent header aligned in the machine direction. Heated air is directed into the crescent headers through inlets 17. Heated air exits the hood interior through outlets 19.

A plurality of nozzle boxes are employed to contribute to the drying of the web as it is transported through the yankee dryer hood by the dryer drum. FIG. 1 illustrates a plurality of such nozzle boxes, each identified by reference numeral 20. The nozzle boxes receive heated air from the crescent headers in a manner to be described more fully below.

Figure 3:
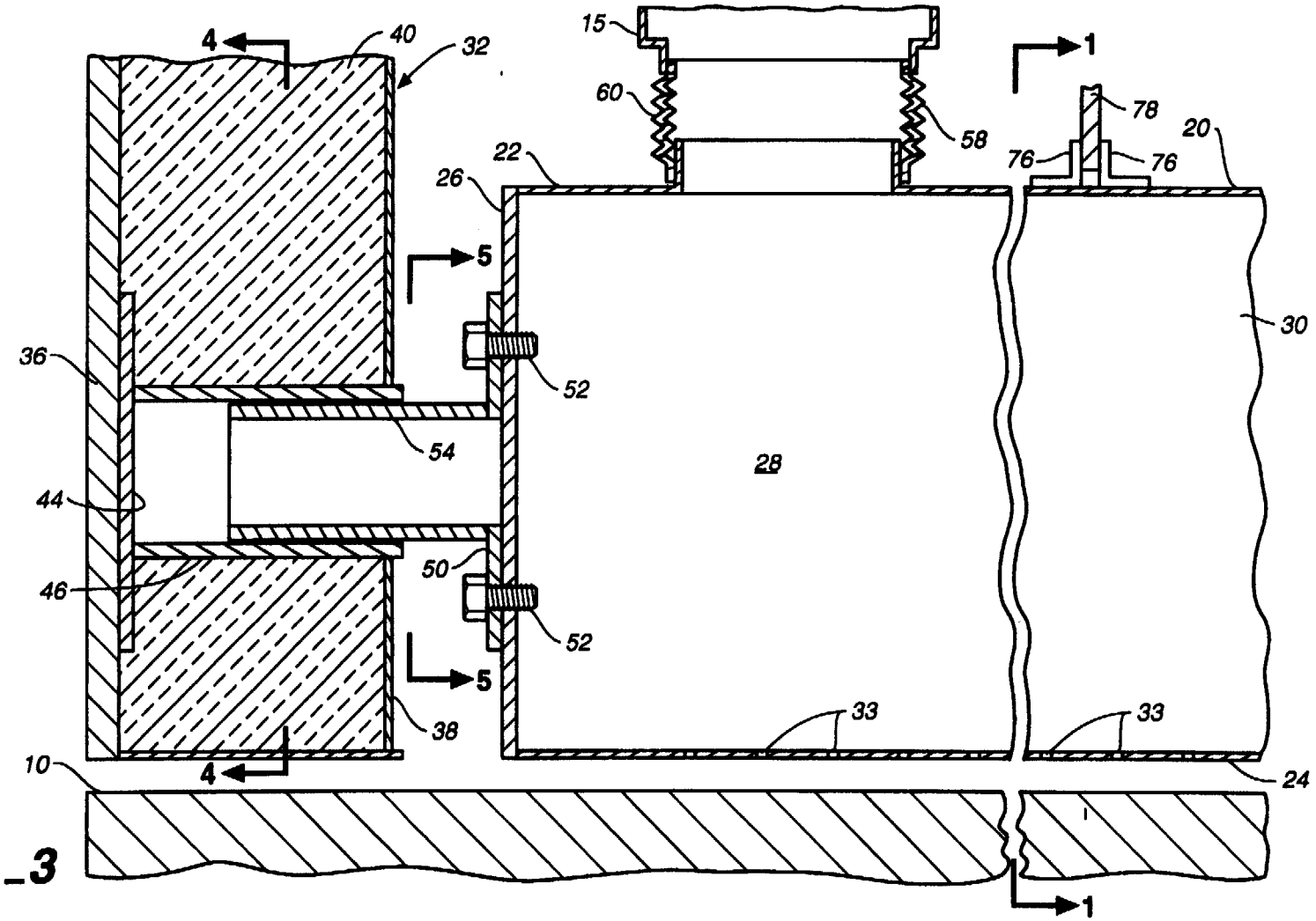
FIG. 3 is a view similar to FIG. 2, but illustrating structure constructed in accordance with the present invention and as taken along the line 3—3 in FIG. 1.
Figure 4:
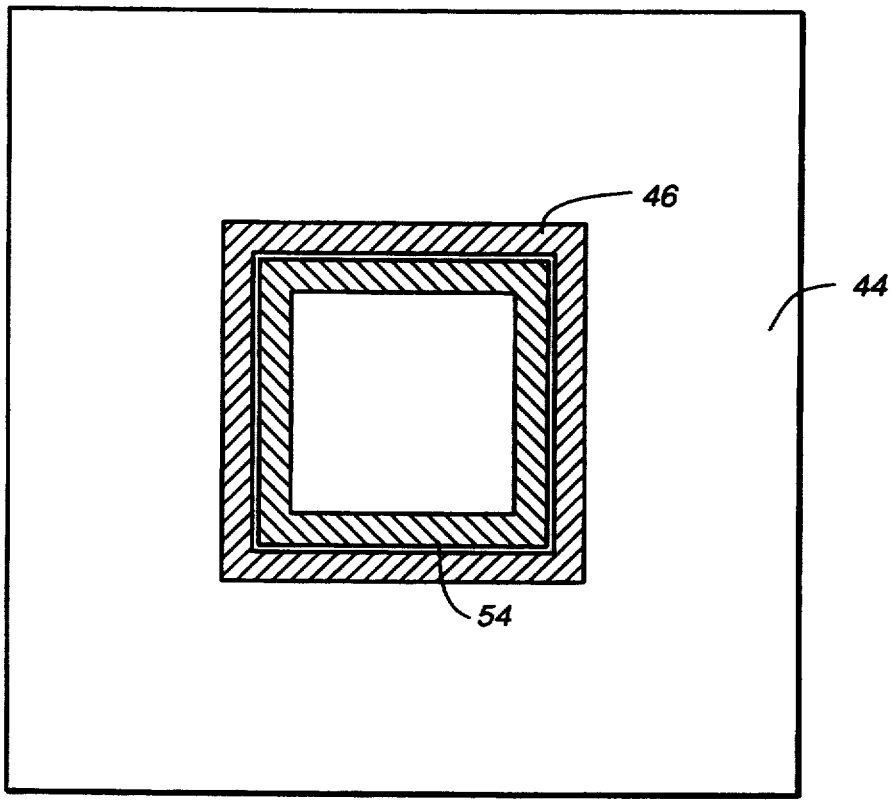
FIG. 4 is an enlarged, cross-sectional view taken along the line 4—4 in FIG. 3.
Figure 5:
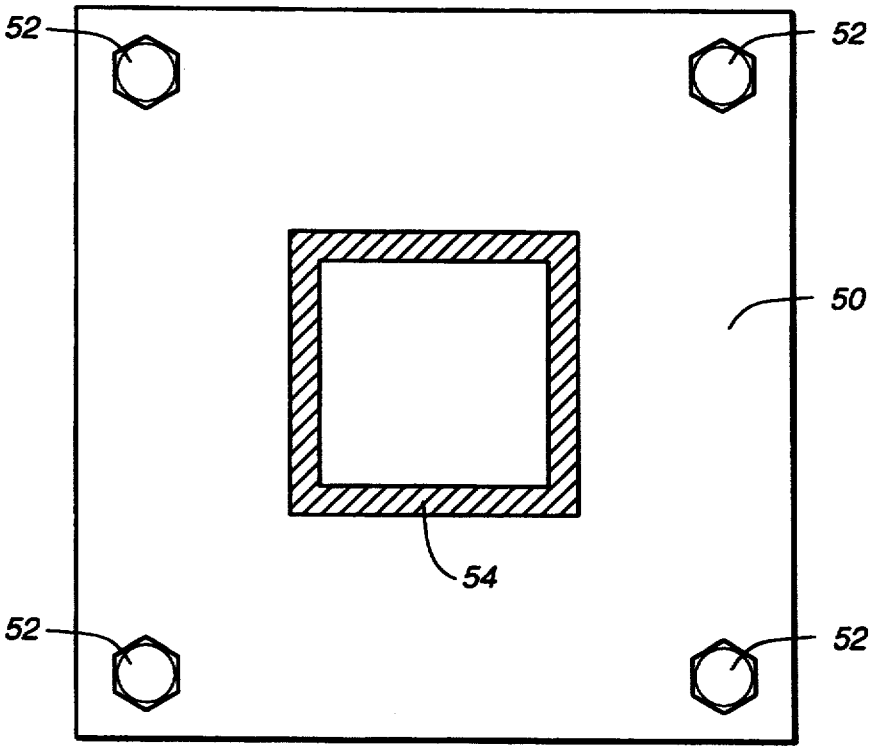
FIG. 5 is an enlarged, cross-sectional view taken along the line 5—5 in FIG. 3.

FIG. 3 illustrates an end segment 22 and a mid or central segment 24 of one of the nozzle boxes 20. It is to be understood that nozzle box 20 shown in FIG. 3 is typically of the same construction as all of the other nozzle boxes employed in the system and that the structure described with respect thereto is the same structure which is incorporated in the other nozzle boxes. Furthermore, in the interest of simplicity, only one end of the nozzle box 20 is shown, it being understood that the other end is of like construction.

Nozzle box 20 includes opposed end walls 26 (only one of which is shown) and opposed side walls 28 (only one of which is shown) which partially define a nozzle box interior 30. Hot gases received from crescent headers 15 (one of which is shown) exit the nozzle box through exit openings 33 formed in a bottom wall thereof. The hot gases are directed toward the paper web supported on the support surface of the drum 10. The gases then proceed between adjacent nozzle boxes 20 as well as alongside the outer surface of each end wall 26 thereof, it being understood that the gases are recirculated relative to the hood in a conventional fashion.

The nozzle boxes 20 are supported by support walls located adjacent to the end walls 26 so that the nozzle boxes are adjacent to the dryer drum with the nozzle boxes extending in the cross-machine direction. In the present instance, the support walls are the side walls of the hood 12. In the drawings only one such support wall 32 is shown; however, it is to be understood that there is an opposed support wall of like structure at the other end of the hood.

Support wall 32 includes a rigid outer side wall 36 and an inner side wall 38 spaced therefrom. The walls 36, 38 may be formed of any suitable material, preferably metal such as alloy steel. An insulating material 40 of any suitable type is sandwiched between outer side wall 36 and inner side wall 38.

A plate 44 is secured to outer side wall 36 by any suitable expedient such as welding. Fixed to plate 44 and extending therefrom is a receptacle 46 having a rectangular cross-section.

An end plate 50 is secured to end wall 26 by threaded mechanical fasteners 52 passing through registered holes in the end plate and end wall. A sleeve 54 of rectangular cross-section is affixed to end plate 50 and protects into receptacle 46. A relatively loose fit exists between receptacle 46 and sleeve 54. The sleeve 54 is capable of axial slidable movement relative to receptacle 46 but not relative rotational movement therebetween.

Affixed to the top of nozzle box 20 are two brackets 76 defining a space therebetween. These brackets are located mid-length of the nozzle box. The space between the brackets accommodates a bar or other structural member 78 secured to the hood.

Engagement between the structural member 78 and the brackets 76 prevents end-wise movement of the nozzle box at the mid-section or center thereof. It will be appreciated that the ends of the nozzle box are, however, free to move toward and away from their respective support walls during changes of temperature within the hood. That is, the nozzle box will lengthen when nozzle box temperature increases and contract or shorten when temperature diminishes. Since the mid-section of the nozzle box is blocked against cross-machine movement by the cooperative relationship existing between brackets 76 and structural member 78, expansion and contraction will likely occur generally equally at both ends of the nozzle box. As previously stated, such movement at the nozzle box ends can occur in unrestricted fashion due to the slidably movable inter-connection between sleeve 54 and the receptacle 46.

Heated air is supplied to the nozzle box by crescent headers 15. As shown in FIG. 3, interconnection between each crescent header and its associated nozzle box is through a conduit 58 including a flexible expansion joint 60 which allows relative movement between the crescent header and nozzle box. Thus the location of the nozzle box relative to the heated drum will not change even though the shape of the crescent header will change when heated or cooled.

Figure 2:
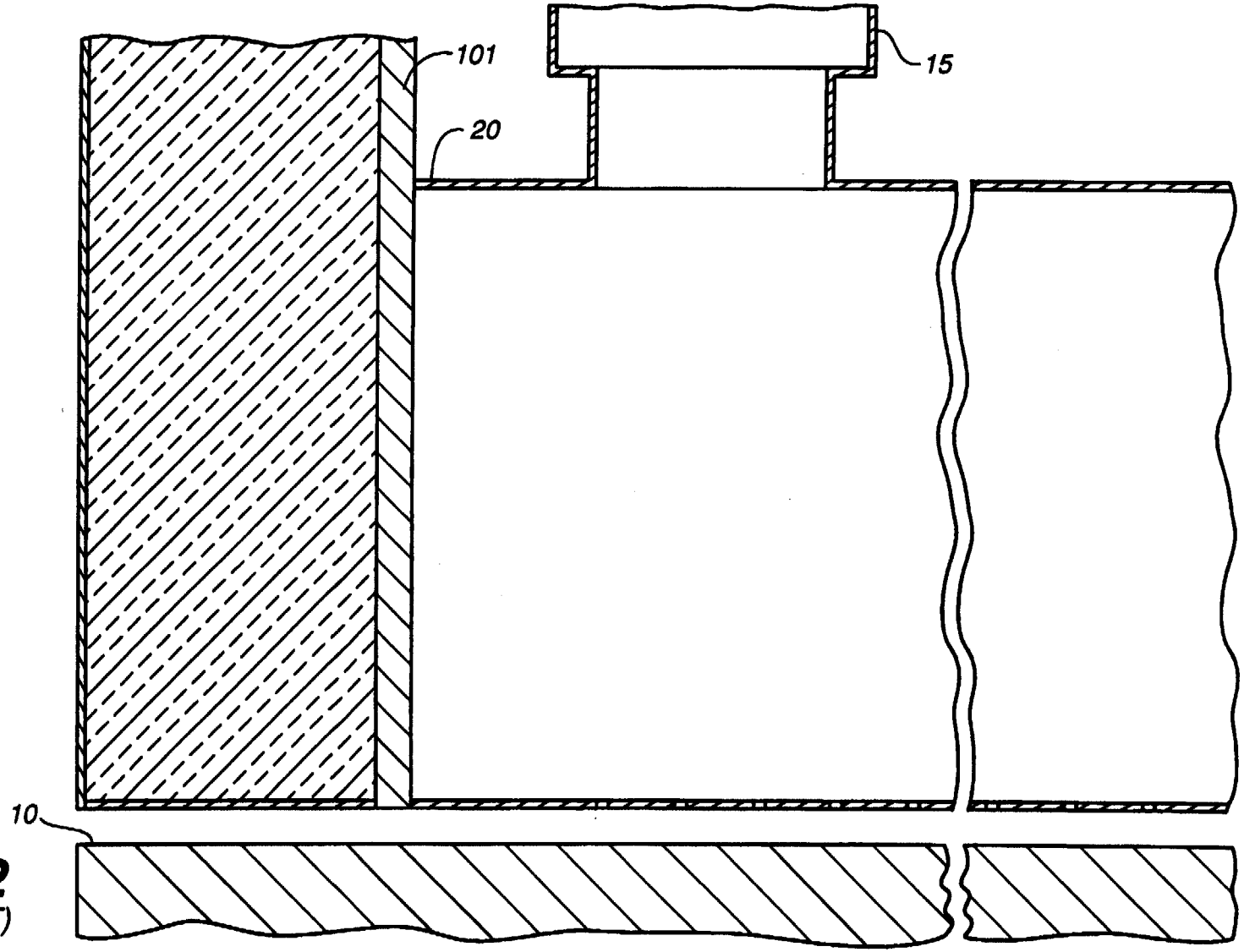
FIG. 2 (PRIOR ART)
FIG. 2 is a cross-sectional, enlarged view illustrating an end segment and a central segment of a nozzle box and an adjacent support wall comprising an end wall of the yankee dryer hood as employed in the prior art.

The above-described arrangement should be compared with the typical prior art arrangement shown in FIG. 2 wherein a nozzle box 20 is directly secured, as by welding, to the inner wall of a hood side wall of double wall construction. In this conventional approach, the inner wall is rigid and load bearing. Thus, distortion of the support wall will cause corresponding movement of the nozzle box. Also, there is no accommodation for lengthwise expansion or contraction of the nozzle box. Furthermore, the nozzle box is rigidly connected to its associated crescent headers 15.

I claim:

1. In a yankee dryer including a rotatable dryer drum having a paper web support surface for transporting a paper web in the machine direction upon rotation of the dryer drum and a hood having a hood interior at least partially encompassing said dryer drum, apparatus comprising, in combination:

a nozzle box including nozzle box side walls and nozzle box end walls defining a nozzle box interior, said nozzle box defining at least one exit opening between said nozzle box end walls for directing heated air from the nozzle box interior toward said dryer drum paper web support surface;

support walls for supporting said nozzle box at a location adjacent to said dryer drum with said nozzle box extending in the cross-machine direction, said support walls comprising two opposed support walls adjacent to and spaced from said nozzle box end walls; and interconnection means interconnecting said support walls and respective nozzle box end walls to maintain said nozzle box at said location, said interconnection means comprising projections having distal ends extending between said support walls and said nozzle box end walls and a receptacle for receiving each said projection distal end and allowing endwise movement of said nozzle box end walls relative to said support walls responsive to expansion and contraction of said nozzle box due to changes in temperature of said nozzle box.

2. The apparatus according to claim 1 additionally comprising header means and air flow conduit means defining a flow path for heated air between said nozzle box and said header means, said air flow conduit means including an expansion joint permitting relative movement between said air flow conduit means and said nozzle box.

3. The apparatus according to claim 1 wherein each said support wall includes a rigid outer side wall and an inner side wall, said outer and inner side walls being spaced from one another, and insulation disposed between said outer and inner side walls to insulate said outer side walls from the hood interior.

4. The apparatus according to claim 3 wherein a rigid support member extends between the outer and inner side walls of each said support wall, said rigid support member comprising said receptacle and defining a recess, a projection being rigidly connected to each of said nozzle box end walls and received in a recess.

5. The apparatus according to claim 3 wherein the inner side walls define return air flow paths with said nozzle box end walls to receive heated air from the vicinity of the dryer drum after said heated air has exited the nozzle box exit opening and been directed toward the dryer drum.

6. The apparatus according to claim 4 additionally comprising nozzle box engaging means for engaging the nozzle box at a nozzle box location generally mid-length of said nozzle box and preventing substantial endwise movement of the engaged nozzle box at said nozzle box location.

7. The apparatus according to claim 6 wherein said projections extend only part way into the interiors of said rigid support members and are slidable relative thereto to allow slidable movement between said projections and said rigid support members responsive to expansion or contraction of said nozzle box.

8. The apparatus according to claim 4 wherein said interconnection means additionally comprises means for maintaining a fixed angular orientation of said nozzle box relative to said dryer drum paper web support surface.

9. The apparatus according to claim 6 wherein at least one projection extends outwardly from said nozzle box generally mid-length thereof, said nozzle box engaging means including a stop element fixedly mounted relative to said hood for engagement with said projection.

10. The apparatus according to claim 1 wherein said supporting walls are hood walls partially defining said hood interior.

* * * * *